United States Patent [19]

Hille

[11] 4,357,739

[45] Nov. 9, 1982

[54] APPARATUS FOR LAYING FIBER FLEECES OR THE LIKE ON A MOVING WITHDRAWAL BELT

[75] Inventor: Eduard Hille, Dülmen, Fed. Rep. of Germany

[73] Assignee: Hergeth KG Maschinenfabrik und Apparatebau, Dülmen, Fed. Rep. of Germany

[21] Appl. No.: 118,827

[22] Filed: Feb. 5, 1980

Related U.S. Application Data

[60] Division of Ser. No. 919,012, Jun. 26, 1978, Pat. No. 4,194,270, which is a continuation of Ser. No. 775,022, Mar. 7, 1977, abandoned.

[51] Int. Cl.[3] ..... D04H 11/04

[52] U.S. Cl. ..... 19/163

[58] Field of Search ..... 19/163

[56] References Cited

U.S. PATENT DOCUMENTS 1,886,919 11/1932 Sturgis ..... 19/163

2,387,150 10/1945 Hlavaty ..... 19/163

FOREIGN PATENT DOCUMENTS 332049 7/1930 United Kingdom ..... 19/163

*Primary Examiner*—Louis Rimrodt

*Attorney, Agent, or Firm*—John C. Smith, Jr.

[57] ABSTRACT

A device is disclosed for laying fiber fleeces or the like delivered from a carding machine of the like onto a withdrawal belt driven at a predetermined speed. The device comprises a feed belt driven at a predetermined speed, storage, layer and balance cars all arranged for oscillating movements, respectively, a first continuous conveyor belt extending about rollers on the storage and layer cars and a second continuous conveyor belt extending about rollers on the storage and layer cars and extending from the storage car to a roller on the balance car. One run of each of the conveyor belts extending between the storage and layer cars confront each other for receiving the fiber fleece therebetween. Common drive means connects the storage and layer cars and further drive means extends from the feed belt to the layer car.

6 Claims, 11 Drawing Figures

APPARATUS FOR LAYING FIBER FLEECES OR THE LIKE ON A MOVING WITHDRAWAL BELT

This is a division of application Ser. No. 919,012 filed June 26, 1978, now U.S. Pat. No. 4,194,270, 25 Mar. 1980 which is a continuation of application Ser. No. 775,022 filed Mar. 7, 1977 (now abandoned).

BACKGROUND OF THE INVENTION

This invention relates to apparatus for laying fiber fleeces or the like, usually supplied from a carding machine or the like, onto a withdrawal belt moving at a predetermined speed.

In high speed apparatus for laying fiber fleeces, any sudden change in speed of the various conveyor belts in the apparatus can cause irregularities and distortions in the fleece layer. Thus, during a sudden acceleration of the conveyor belts the fleece does not follow immediately, and at high operational speeds air currents are generated which tend to raise the fleece from the belts and can lead to narrowing or stretching of the fleece at points between conveyor belts.

One of the objectives in designing apparatus for laying fiber fleeces has been to provide control means for maintaining the conveyor belts in a predetermined relationship whereby the fleece layer is maintained more uniform. In prior art apparatus each conveyor belt is frequently controlled by a separate DC motor, the DC motors enabling digital control of the speeds of the belts. This, however, requires a complex and therefore expensive control device and also requires continuous supervision by highly skilled personnel. Furthermore, the adverse affects caused by air currents are not eliminated.

Other prior art devices have been designed to decrease the high rate of acceleration. This is difficult to control, however, as the fleece is fed to the apparatus at constant speed and must be withdrawn at constant speed.

Another prior art apparatus is known in which there is a feed belt driven at a predetermined speed, a reciprocably movable main or storage car and laying car and two conveyor belts which extend partially parallel to each other between the main and layer cars. One of the conveyor belts, a main belt, passes over rollers on the main and layer cars. Three auxiliary cars are provided which are intended to effect balance of the belt speeds during laying of the fleece in a cross-over form. Also, the drive requires at these two different gears. This apparatus has the disadvantage that it is relatively expensive and complex, both in structure and with respect to the control device required to operate the apparatus.

An object of the present invention is to provide apparatus for laying fiber fleeces which has a simplified construction and reduction in the number of parts.

A further object of the invention is to provide an apparatus in which control of the synchronous running of the moving parts is simplified.

SUMMARY OF THE INVENTION

The apparatus of the present invention includes a feed belt, a main car, a layer car, a storage car, and two conveyor belts which extend in part parallel to one another between the main and layer cars. One of the conveyor belts passes as a main belt over rollers on both the main and layer cars. The storage car has rollers around which the second conveyor belt passes. A single balance car is provided for the main belt, and the storage and layer cars are connected by a common drive unit, e.g. a chain which derives its drive from the feed belt and via the driven layer car.

The main belt which runs over both the layer and balance cars passes around the end of the storage car. This construction is compact as extra space is not required for belt travel. Only one storage car is required. It is possible for the speed of the layer car to be changed by means of the balance car to a speed different from the fleece speed, control being maintained by the common drive unit, i.e. by synchronization of the control chain. It will be appreciated that all parts of the apparatus are easily accessible and easily maintained.

The storage car has a jib supporting the second conveyor belt. The control chain may be passed over the end of the jib to the layer car. In this case the control chain is advantageously passed over a gear wheel non-rotarily connected to a laying roller of the layer car. This serves as one of the two drives for the control chain. The other drive for the control chain is derived directly from the driven speed belt.

From the driven belt wheel of the feed belt a drive chain leads over the roller of the main belt on the balance car. The drive for the second conveyor belt located on the storage car is derived from the driven main belt. Both belts thus run at the fleece speed or doffer speed. The layer car can be arranged to move reciprocably by means of a car traction chain and two gear wheels. The gear wheels mesh with a stationary measuring chain, the gear wheels being alternately provided in opposed directions with freewheel clutches. Thus, each individual layer roller of the layer car is respectively driven by each gear wheel. The measuring chain which is an endless chain passing over wheels is driven by movement of the car traction chain. This drive means eliminates the hydraulic lines normally required to operate the clutch located on the layer car which must be continuously reciprocated. The driving force is applied to those drive parts which are non-rotarily supported. The measuring chain is simply driven by the car traction chain, and consequently the layer car which is subjected to continual reciprocating motion is made considerably lighter, an important feature since the layer car is continuously being braked and accelerated.

The drive for the measuring chain is derived from a turning wheel of the car traction chain, the shaft of the turning wheel of the car traction chain being connected with the shaft of the turning wheel of the measuring chain at a drive ratio of 2:1. The corresponding chainwheels which are connected by a chain can be designed with a corresponding transmission ratio so that the shaft of the measuring chain revolves twice as fast as the shaft of the car traction chain, the turning wheels on both chains being the same size.

A clutch is located on the chain wheel of the measuring chain to engage and disengage its shaft. To effect a change in the direction of the power flow without change in direction of the layer car, a freewheel device is located on the shaft for the drive of the measuring chain. The freewheel device is attached to the machine frame and prevents the shaft of the measuring chain from rotating in the wrong direction. The engagement of the endless measuring chain with the layer car is preferably effected in such a way that the endless measuring chain is passed over a turning chainwheel of the layer car.

DETAILED DESCRIPTION OF INVENTION

Figure 1:
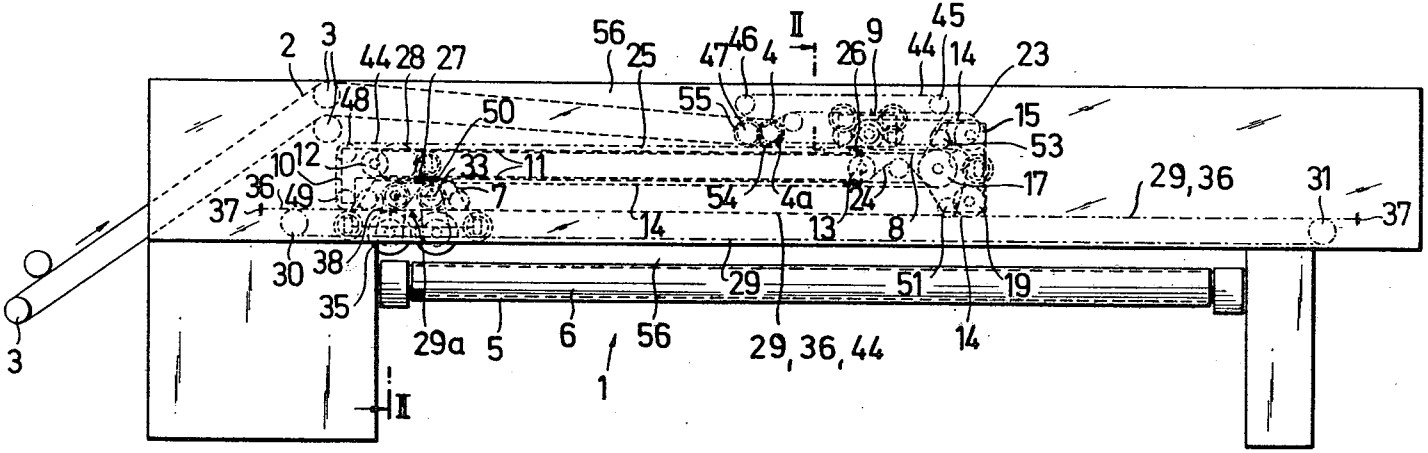
FIG. 1 is a diagrammatic side elevation of a first embodiment of the fleece laying machine.
Figure 1A:
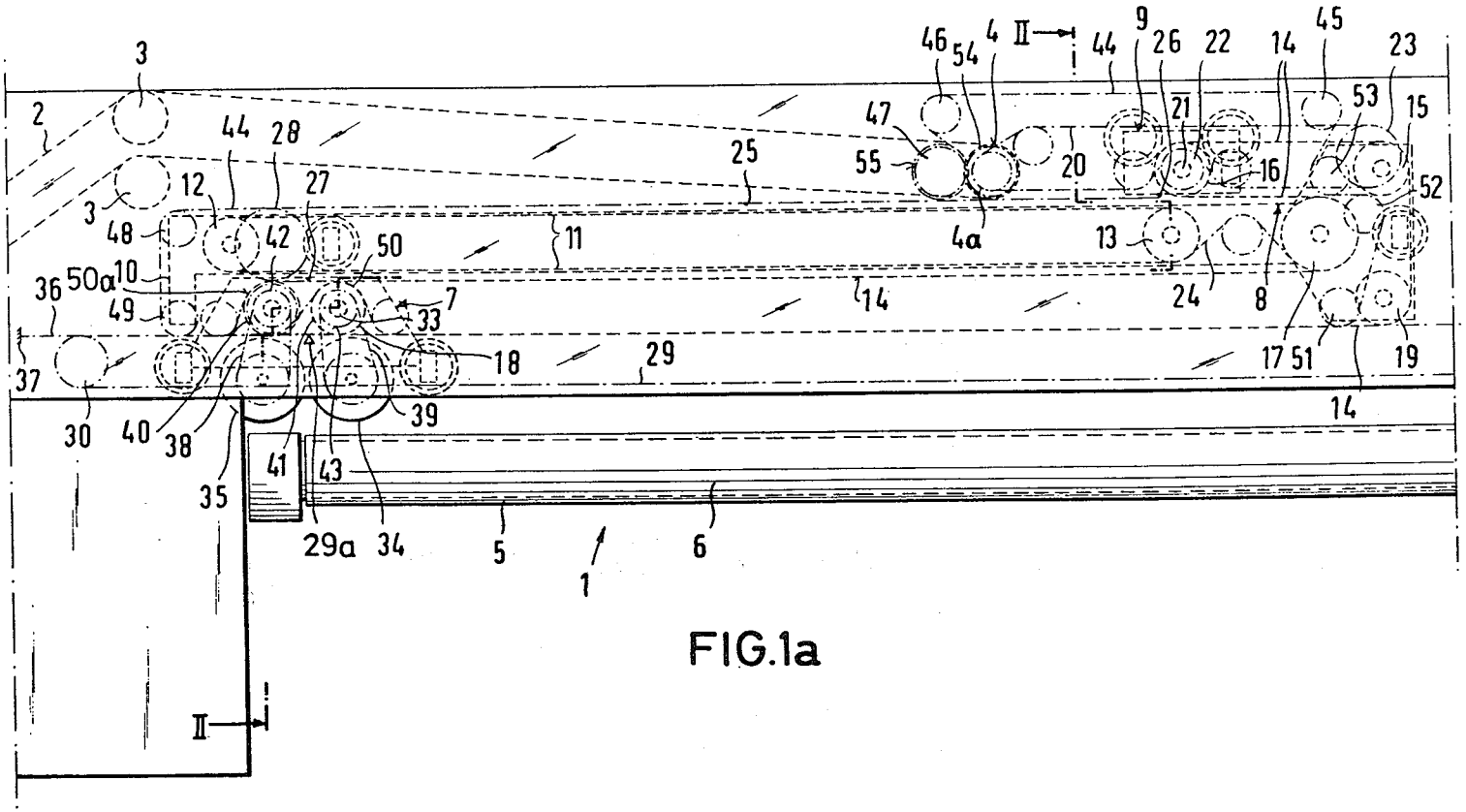
FIG. 1*a* is a view similar to FIG. 1 on an enlarged scale.
Figure 2:
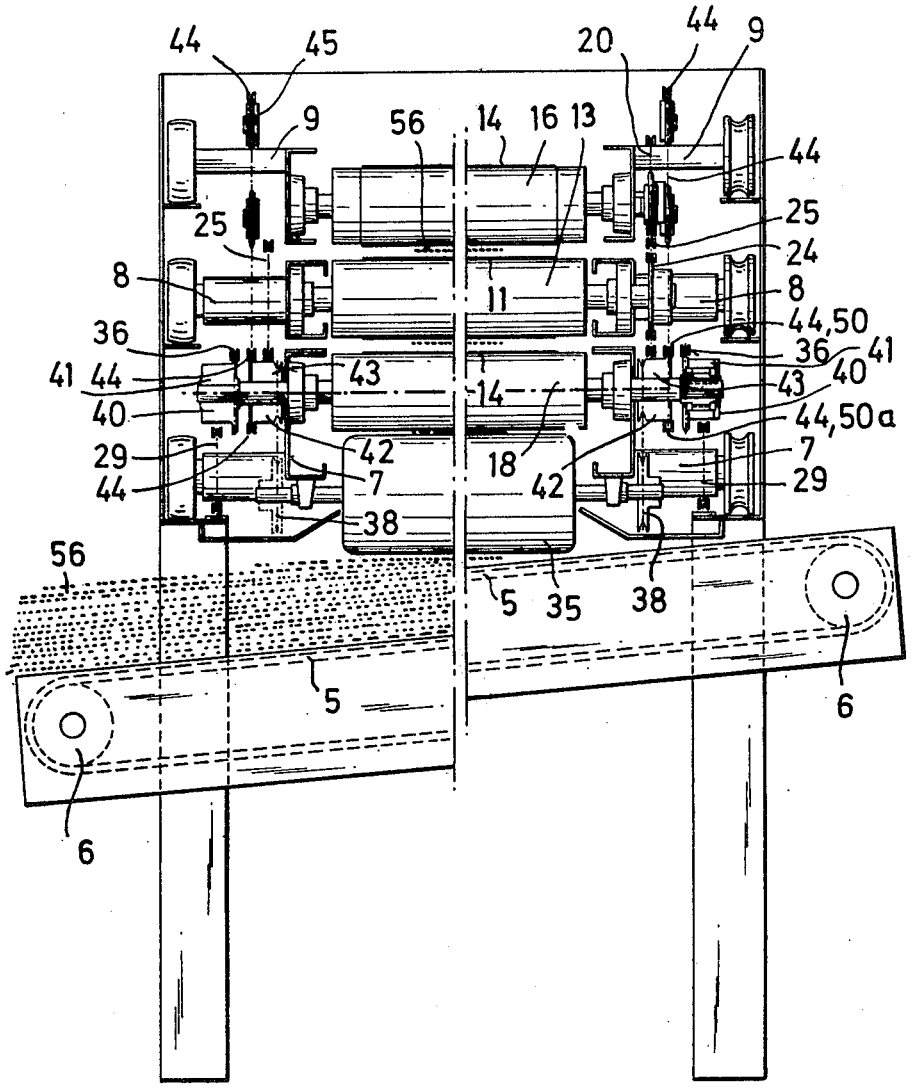
FIG. 2 is a cross-sectional view taken along the line II—II of FIG. 1 illustrating the position of the individual drive elements.
Figure 3:
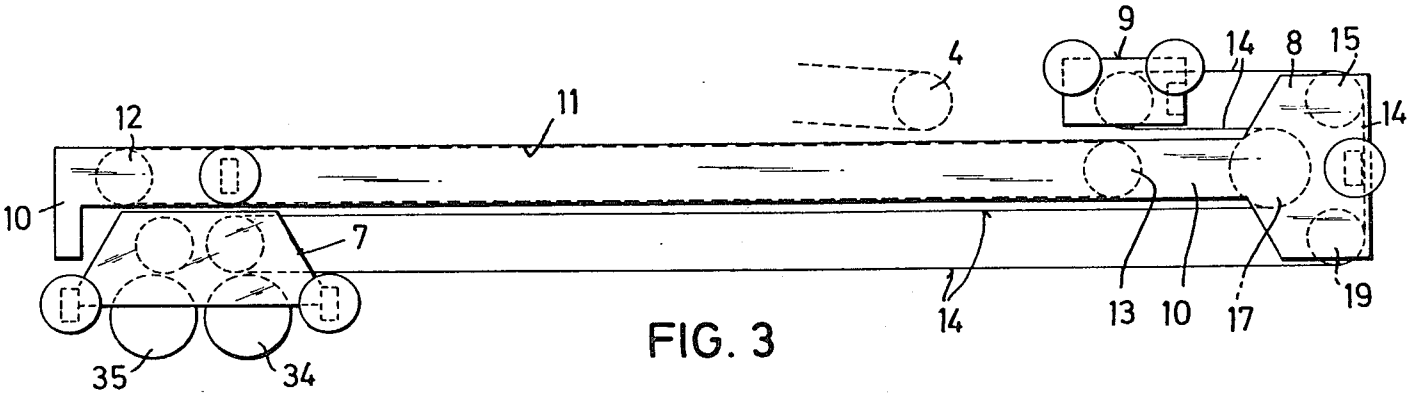
FIG. 3 illustrates the layer car, the balance car and the storage car, the conveyor belts having been omitted.
Figure 4:
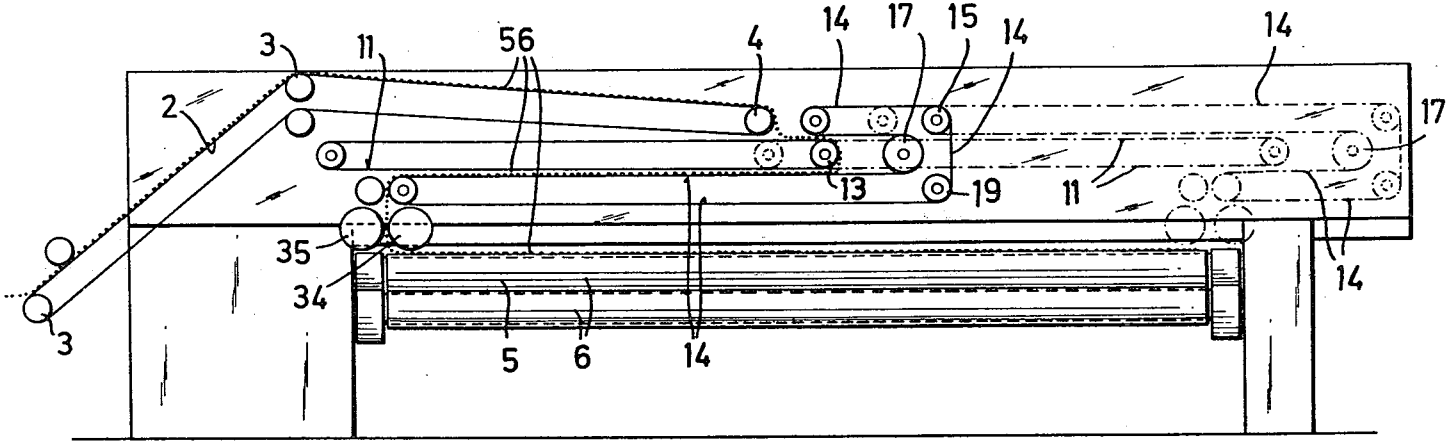
FIG. 4 is a diagrammatic front elevation of the fleece-laying machine showing the cars at their maximum end positions.
Figure 5:
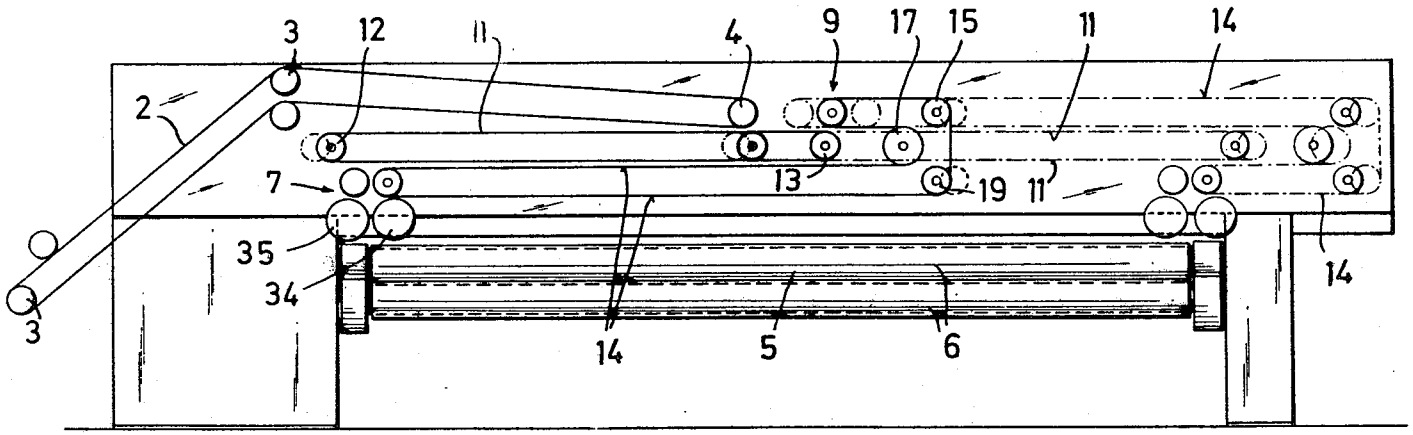
FIG. 5 is similar to FIG. 4 but shows the positions of the balance car and the storage car when the speed of the layer car does not coincide with the fleece speed.

The fleece-laying machine 1 has a feed belt 2 with rollers 3 and driven belt roller 4. Located transversely to the feed belt 2 is a withdrawal belt 5 on roller 6. The fleece material is deposited transversely and in a zig-zag configuration relative to the direction of feed belt 2. Instead of a transversely-moving belt 5 the withdrawal belt may run longitudinally, i.e. in the same direction as the feed belt 2. The fleece-laying machine includes three cars, namely, a layer car 7, a storage car 8 and a balance car 9. The storage car 8 is provided with a jib 10 on which is located a conveyor belt 11 which passes between rollers 12 and 13. A further conveyor 14 extends from roller 15 of the storage car 8, over a roller 16 of the balance car 9 back to a roller 17 on storage car 8, and from this point to a roller 18 of the layer car 7 and back to a roller 19 of the storage car 8, and from this point again to roller 15. The conveyor belt 14 of the storage car 8 thus extends both to the balance car 9 and also to the layer car 7, the latter being movable reciprocably across the width of the withdrawal belt 5.

The belt roller 4 of the feed belt 2 is driven at a predetermined speed, preferably the doffer speed of a carding machine or the like. From the drive wheel 4*a* of belt roller 4 a drive chain 20 extends over a chainwheel 22 on axle 21 of the roller 16 for the conveyor belt 14, the drive chain extending over a fixed roller 23 back to the chainwheel 4*a*. Thus, the conveyor belt 14 is driven from a driven belt roller 4 of the feed belt 2, and the belt 11 on jib 10 of the storage car 8 is driven by roller 17 located on the storage car 8 by means of chain 24 which extends over a chainwheel on the axle of the roller 13. Thus, belt 11 is driven at the same speed as belt 14.

The layer car 7 and the balance car 9 are connected together by a tension chain 25. The tension chain 25 is attached at 26 to the balance car 9 and at 27 to the layer car 7 and extends over a roller 28 mounted on the jib 10 of storage car 8.

Layer car 7 is driven by a car traction chain 29 which passes over fixed rollers 30 and 31. The upper bight of the car traction chain 29 is rigidly connected at 29*a* to the layer car 7. Rotation of rollers 34 and 35 is effected by a measuring chain 36 stretched between two countersupports 37. The withdrawal rollers 34, 35 or laying rollers are connected by transmission members 38, 39 to chainwheels 40, 41 via wheels 42, 43. Chainwheels 40, 41 are provided with free wheel clutches, respectively, which operate in opposite rotary directions, insuring that the rotary direction of the laying rollers 34, 35 always remains the same when the layer car 7 changes direction. The car traction chain 29 is driven by a reversible geared motor, e.g. a DC motor.

A common drive unit is provided between the three cars, namely, the layer, storage and balance cars. The drive unit comprises a common control chain 44. The chain 44 leads from the fixed rollers 45, 46 over a fixed driven roller 47 to rollers 48 and 49 on the jib 10 of storage car 8, from this point over chainwheels 50 and 50*a*, one of which is driven, depending upon the direction of movement of layer 7, and back over rollers 51, 52 and 53 located on the storage car 8. The chain wheel 50 is fixed on the same axle on which wheel 43 is located. Wheel 43, however, has a smaller diameter than the chain wheel 50. The control chain 44 also extends over chain wheel 50*a* which is rigidly connected to wheel 42. Roller 47 is driven through belt roller 4 by means of corresponding intermeshing gear wheels 54 and 55.

The operation of the fleece-laying machine is as follows. The fleece 56 is fed over the feed belt 2 and is then passed over roller 13 of conveyor belt 11 between the two bights of the conveyor belts 11 and 14 to the layer car 7 and between the laying rollers 34, 35 onto the withdrawal belt 5 where it is deposited in a continuous reciprocating motion on the withdrawal belt 5. FIG. 1 shows the positions of the cars at the beginning of the laying process. The peripheral speed of the belt roller 4 at the intake corresponds to the fleece speed or the doffer speed. This speed is on the one hand transmitted to the control chain 44 by means of the roller 47 and on the other hand by the drive chain 20 to the belt roller 16 of the balance car 9. The layer car 7 is set in motion via the car traction chain 29. The measuring chain 36 thus automatically sets the right chain wheel 41 of the layer car 7, with power connected to the shaft, in rotation, while the other chainwheel 40 is uncoupled, or the free wheel is effective. The control chain 44 is driven by the chainwheels 50 or 50*a* which run synchronously with the laying rollers 34, 35. It should be noted that the control chain 44 is driven at two different points.

When the layer car 7, seen in the plane of the drawing, moves to the right, there is imparted to the storage car 8 by the control chain 44 a movement in the same direction as that of the layer car 7 but at only half the speed. When the movement of the layer car 7 is at fleece speed, no traction is exerted on the balance car 9 either via the tension chain 25 or via the main belt 14.

When the speed of the layer car 7 is lower than that of the fleece, then there is imparted by the control chain 44 to the storage car 8 an additional movement in the direction of the movement of the layer car 7 so that the storage car 8 reaches half the fleece speed, i.e. is accelerated. The fleece 56, entering at constant speed, is therefore stored without residue by the movement of the storage car 8. As in this case the layer car 7 is moved slower than twice the speed of the storage car 8 and the main belt 14 is drawn around the rollers 19, 15 of the storage car 8. The result is that the balance car 9 moves to the right because of the traction exerted by the main belt 14.

During the movement of the layer car 7, the car speed must exceed the fleece speed, if the fleece speed at the turning point or at the beginning of the laying stretch has not been achieved. This is necessary for the median speed of the layer car 7 to be equal to the doffer speed.

When the layer car 7 reaches fleece speed the movement of the balance car 9 to the right ceases and is transformed, on exceeding the fleece speed, through the layer car 7 into a movement to the left, this movement is achieved by traction from tension chain 25.

When it has passed over the full laying width, the layer car 7 is reversed and travels to the left. Control of the layer car 7 is effected via the car traction chain 29 which is correspondingly driven. During the reversal, the right chainwheel 41, which has transmitted the rotation caused by measuring chain 36, is uncoupled or the free wheel becomes defective and the left chainwheel 40 is coupled to the shaft.

When the speed of the layer car 7 is less than the fleece speed, the control chain 44 imparts to the storage car 8 a movement opposite in direction to that of the layer car 7. When the speed of the layer car after reversal to the left is zero, the storage car 8 continues at half the fleece speed towards the right. Only when the speed of the layer car 7 during the return is higher than half the fleece speed does the storage car 8 likewise move in the direction of the layer car 7 to the left.

The balance car 9 executes the same movements in the reverse phase as during the forward phase. When the speed of the layer car 7 is less than the fleece speed, the balance car 9 moves to the right; if it is above the fleece speed, the balance car moves to the left. When only one balance car is present the balance of the movements of the cars and of the speeds is effected by the common control chain 44 driven by the belt roller of the feed belt and by the movement of the layer car passing through the storage car 8 and the layer car 7. Alternatively, the control chain 44 can be passed to the belt roller 21 of the balance car 9 and drive chain 20 can then be eliminated.

In the further embodiment illustrated in FIGS. 6–10, an endless measuring chain **36*a* is provided for rotating rollers 34, 35, the drive for the endless measuring chain 36*a* being derived from the car traction chain 29. The measuring chain 36*a* is passed over the wheels 57, 58 and drive for the movable measuring chain 36*a* is effected from the wheel 57**.

The shaft 59 carrying wheel 57 is driven by a shaft 65 to which the wheel 30 for the car traction chain 29 is non-rotarily connected. Drive is effected via chainwheel 63, chain 64 and chainwheel 60; chainwheel 60 only being half the diameter of chainwheel 63. The shaft 59 thus rotates at twice the speed and moves the measuring chain **36*a* at twice the speed, wheel 57 having the same diameter as wheel 30**.

Figure 6:
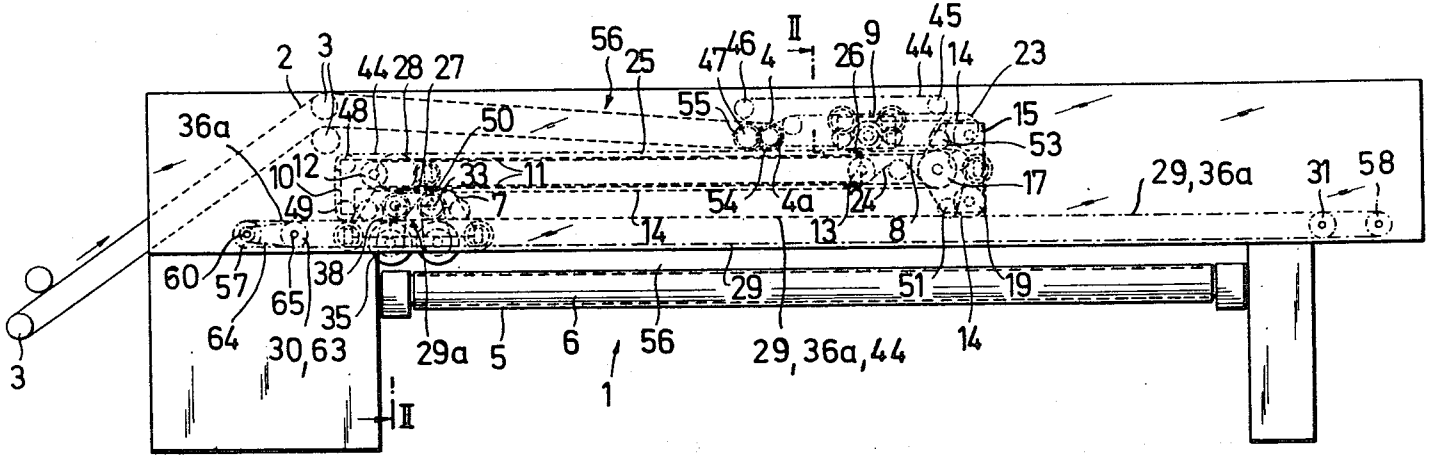
FIG. 6 is a diagrammatic side elevation of a further embodiment of the fleece-laying machine.
Figure 6A:
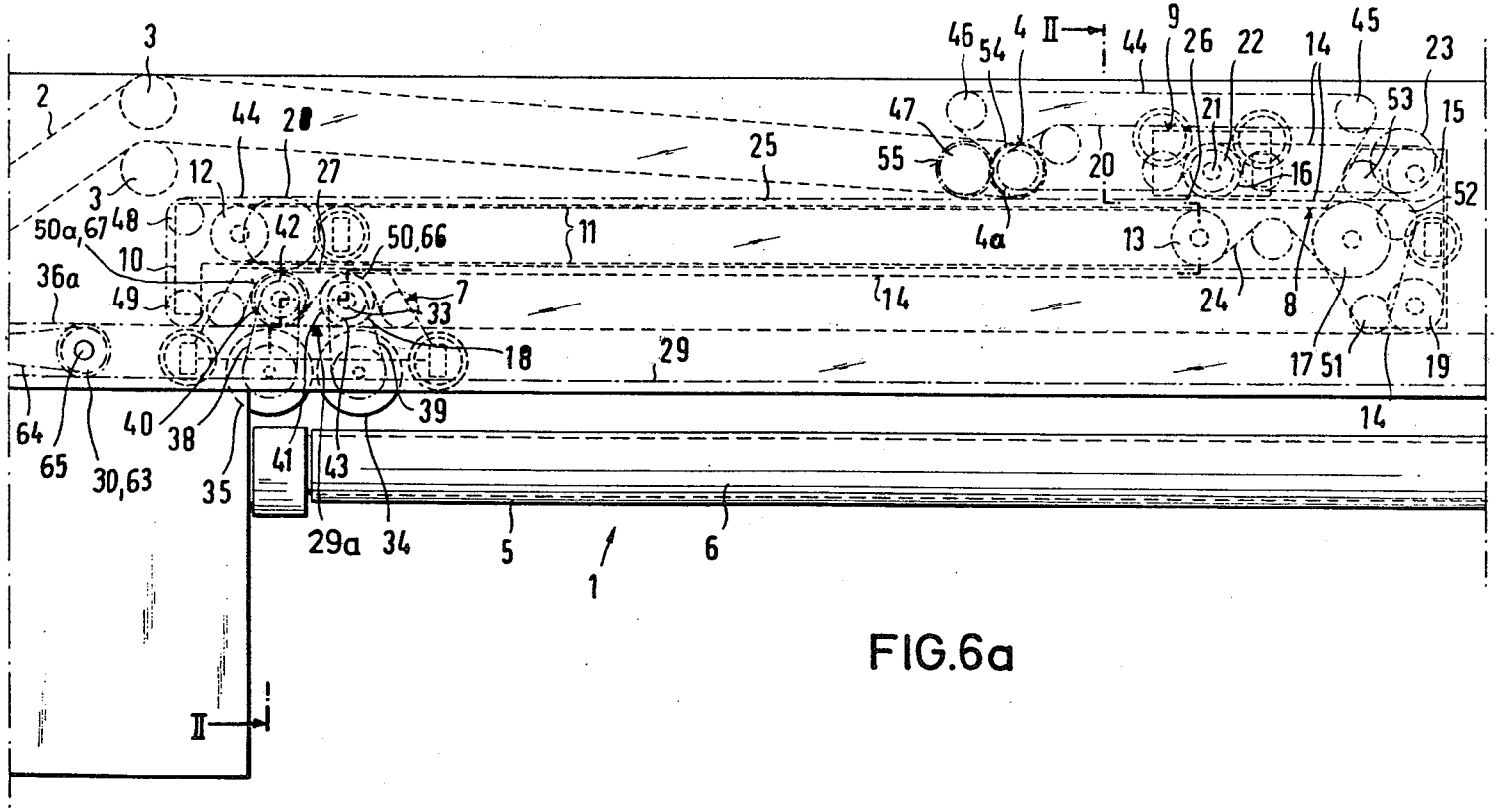
FIG. 6*a* is a view similar to FIG. 6 on an enlarged scale.
Figure 7:
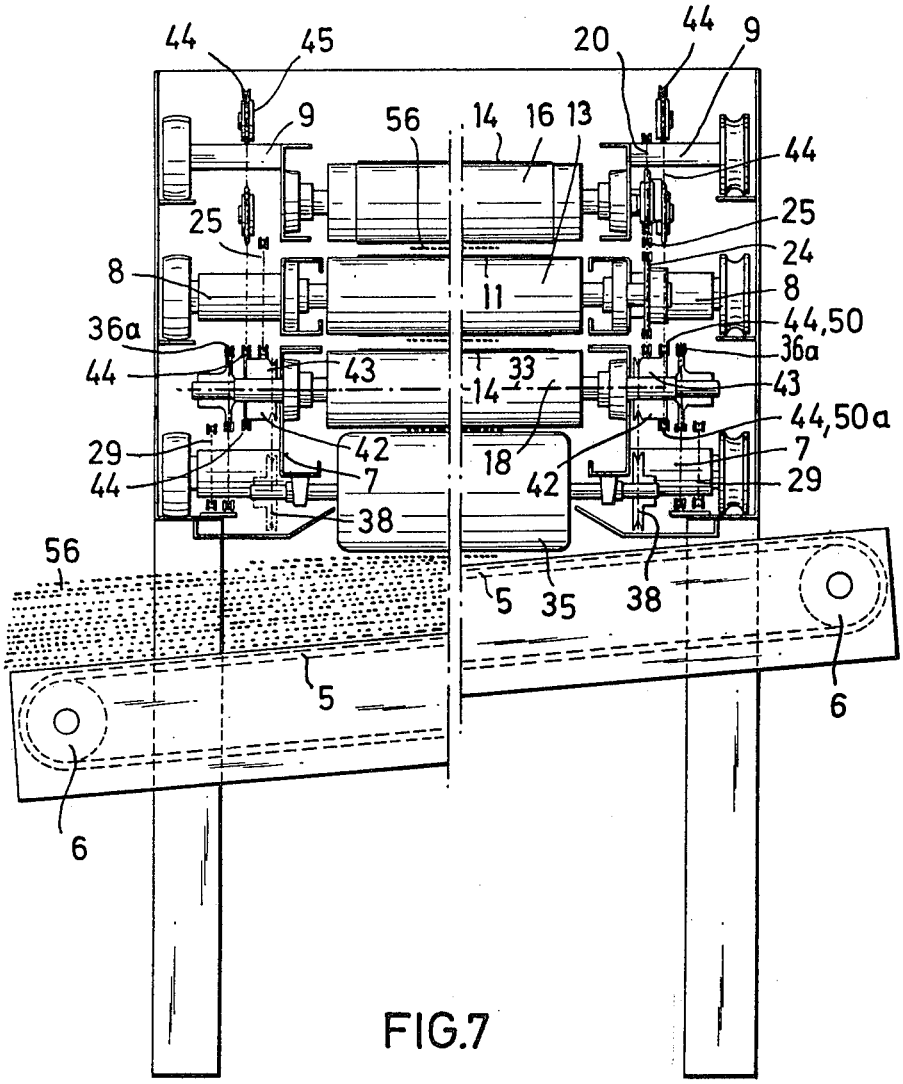
FIG. 7 is a cross-sectional view taken along the line II—II of FIG. 6 illustrating the position of the individual drive elements.
Figure 8:
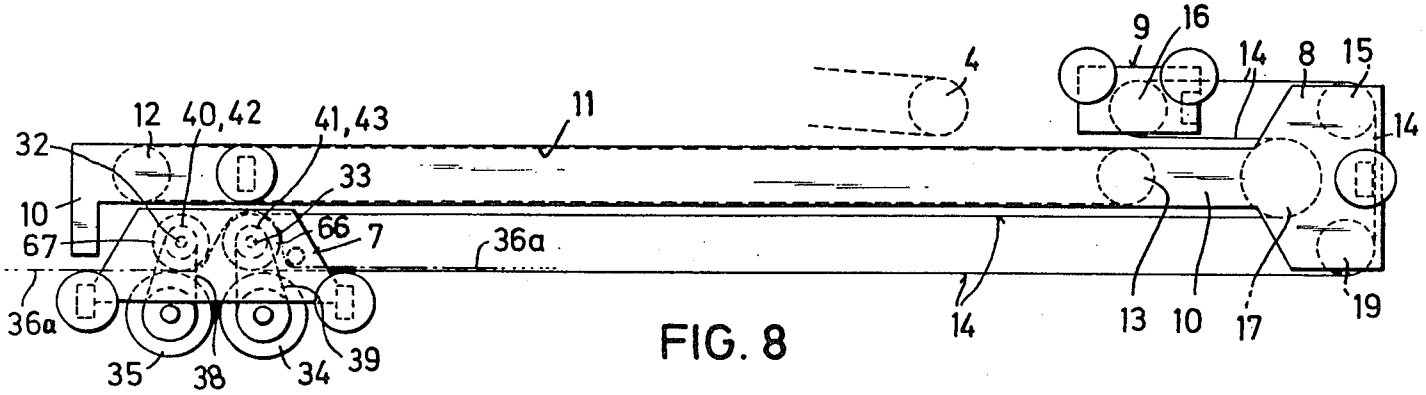
FIG. 8 illustrates the layer car, the balance car and the storage car, the conveyor belts having been omitted.
Figure 9:
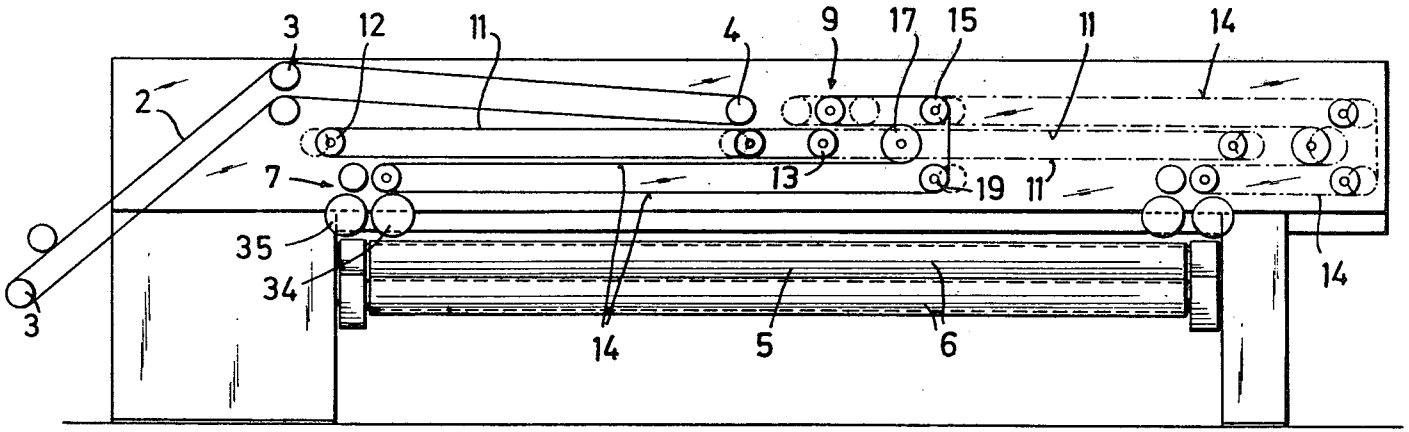
FIG. 9 is a diagrammatic front elevation showing the positions of the balance car and the storage car when the speed of the layer car does not coincide with the fleece speed.
Figure 10:
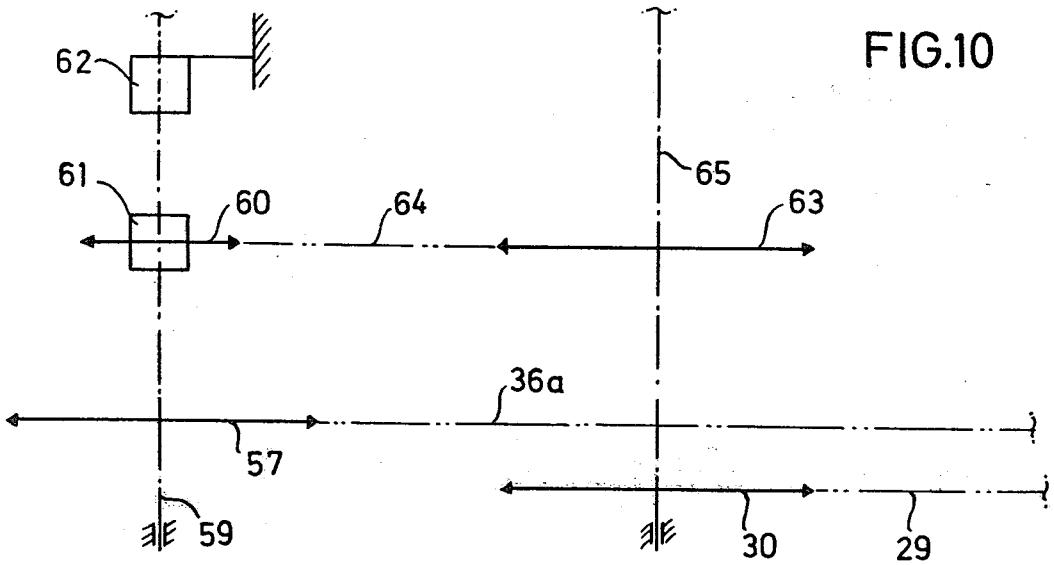
FIG. 10 is a diagrammatic plan view of the drive means for the endless measuring chain.

Chain wheel 60 and shaft 59 are releasably connected to each other by a clutch 61. Also, a freewheel device 62 is located on the shaft 59, the freewheel device being stationarily mounted and preferably fixed to the frame of the machine. The freewheel device 62 prevents rotation of shaft 59 clockwise as viewed in FIGS. 6 and **6*a*. Clutch 61 is engaged when the layer car 7 (FIGS. 6 and 6*a*) moves to the left; in this case the shaft 59 rotates anti-clockwise and the measuring chain 36*a* is moved at double speed relative to the speed of layer car 7. At the left turning point of layer car 7 the clutch 61 is disengaged and measuring chain 36*a* becomes stationary. The layer car 7 then moves to the right. Thus, there is exerted on measuring chain 36*a* a tractive force which would rotate shaft 59 clockwise were it not prevented by the freewheel device 62. At the right turning point (FIGS. 6 and 6*a*) of the layer car 7 the clutch 61** is again engaged.

Measuring chain **36*a* extends to the layer car 7 over chainwheel 66, 67 (FIG. 6*a*) which are mounted on shafts 33 and 32, respectively, alternately around the chainwheels on opposite sides thereof. When the layer car 7 reverses its direction the rotary direction of layer rollers 34, 35** remains the same.

When the layer car 7 travels to the right (FIGS. 6 and **6*a*), the clutch 61 is disengaged. The rotary movement of the car traction shaft 65 is not transmitted to the shaft 59. The measuring chain 36*a* remains stationary. The storage car 8 in this instance also moves to the right. Frictional forces exert through the synchronous chain, the chainwheels on the layer wheel and the measuring chain 36*a* a force on the chainwheel 57 which would turn shaft 59 clockwise. This is prevented, however, by the free wheel 62 which is stationarily mounted. When the layer car 7 is at the right reversing point, the shaft 65 is stationary for the period of reversal. At this moment the clutch 61 is engaged in order to transmit the incipient rotary movement of shaft 65 (anti-clockwise) to the shaft 59 and by means of its transmission to impart to measuring chain 36*a* double the layer car speed. This direction of rotation is permitted by free wheel 62**.

Measures may be taken to guarantee precise reversal without requiring adjustment. The part 61 may consist of a clutch and a free wheel arranged in parallel therewith to provide the power connection between the chain wheel 60 and the shaft 59. This parallel-mounted free wheel is present in addition to the free wheel 62. When the rotary movement of the layer car shaft 65 is initiated counter-clockwise, free wheel 62 is released and practically at the same instant the power flow is produced by the free wheel in part 61. The clutch in part 61 is engaged at an optional moment in time later, but before the impulse initiated by the braking or reversing movement of the layer car 7. With this arrangement it is no longer important to engage the clutch at a predetermined point in time. When the braking or reversing procedure with change in direction of the power flow is effected, an exact transmission of the rotary speed at any moment is guaranteed by the clutch. Disengagement of the clutch must again be effected at a specific point in time. The declutching procedure, however, takes considerably less time than the clutching procedure so that the necessary switching accuracy in this reversal point is easier to achieve.

While various modifications of the above described device have been shown and described in detail, it is obvious that further modifications and changes may be made within the scope of the invention without departing from the spirit thereof.

I claim:

1. A device for uniformly laying fiber fleeces or the like delivered from a carding machine or the like onto a belt driven at a predetermined speed, said device comprising (a) a feed belt extending between rollers;

(b) support means;

(c) a storage car, a layer car and a balance car;

(d) means mounting each of said cars on said support means for oscillating movement along respective substantially parallel paths, the path of said balance car being spaced from the end of said feed belt, the path of said storage car being below said feed belt and the path of said balance car, and the path of said layer car being below the path of said balance car;

(e) a first continuous conveyor belt extending below the end of said feed belt between spaced rollers on said storage car for receiving and conveying fleece in one direction along a path from said feed belt;

(f) a second continuous conveyor belt extending in said one direction from at least one roller on said balance car, about one end of the path of said first conveyor belt on a plurality of rollers on said storage car and then in the opposite direction to at least one roller on said layer car;

(g) means for driving said feed belt and said first and second conveyor belts, said drive means being adapted to drive said feed belt and said first conveyor belt at the same speed;

(h) flexible tension means connecting said balance car to said layer car, said flexible tension means passing over a roller on said storage car;

(i) reversible drive means for oscillating said layer car along its path;

(j) an endless member mounted for travel about at least two spaced rollers and being operatively connected through transmission means on said layer car to said at least one roller on said layer car, one run of said endless member extending along the path of said layer car, said transmission means being adapted to drive said at least one roller in a single direction as said layer car oscillates along its path;

(k) further transmission means between said reversible drive means and one of said rollers about which said endless member passes, said further transmission means being adapted to drive said endless member such that said one run moves in one direction at twice the speed said reversible drive means moves said layer car as said layer car moves in said same one direction and to not drive said endless member as said layer car moves in the opposite direction; and (l) a common continuous drive member extending from a roller driven by said first driven means about rollers at opposite ends of said storage car and about a roller on said layer car and driven in one direction by said transmission means on said layer car;

(m) whereby said storage car with said first conveyor belt oscillates along its path at half the speed said layer car oscillates along its path, when the speed of said layer car is the same as the speed of said feed belt said balance car remains stationary and when the speed of said layer car differs from the speed of said feed belt said common continuous drive member changes the speed of said storage car to maintain it at half the speed of said layer car and said balance car moves along its path in a direction opposite to that of said layer car to maintain said second conveyor belt under tension.

2. A device according to claim 1 further comprising means to prevent movement of said one run of said endless member in said opposite direction during movement of said layer car in said opposite direction.

3. A device according to claim 2 wherein said reversible drive means for oscillating said layer car along its path comprises a continuous traction means extending about fixed rollers mounted on said support means beyond opposite ends of the path of said layer car, said traction means being fixed at one point along its length to said layer car and means for reversibly driving said car traction means.

4. A device according to claim 2 wherein said further transmission means comprises a first rotatably-mounted shaft mounting one of said rollers about which said continuous transction means passes; a second rotatably-mounted shaft spaced from said first shaft mounting said one roller about which said endless member passes; a further pair of rollers one mounted on said first shaft and the other mounted on said second shaft; said other roller having a diameter twice that of said one roller; endless means extending about said pair of rollers; and clutch means adapted to selectively transmit rotary motion to said one roller about which said endless member passes only during movement of said layer car in said one direction; and said means to prevent movement of said one run of said endless member in the opposite direction comprises a free wheel device for preventing rotation of said second shaft in one direction.

5. A device according to claim 1 wherein said storage car includes an elongated jib supporting said first conveyor belt.

6. A device according to claim 5 further comprising a pair of rollers on said layer car between which said fiber fleece is fed onto said withdrawal belt.

* * * * *